US006561635B1

(12) United States Patent
Wen

(10) Patent No.: US 6,561,635 B1
(45) **Date of Patent: *May 13, 2003**

(54) INK DELIVERY SYSTEM AND PROCESS FOR INK JET PRINTING APPARATUS

(75) Inventor: Xin Wen, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/928,002

(22) Filed: Sep. 11, 1997

Related U.S. Application Data

(63) Continuation-in-part of application No. 08/846,923, filed on Apr. 30, 1997, now abandoned.

(51) Int. Cl.[7] ..... B41J 2/175
(52) U.S. Cl. ..... 347/85
(58) Field of Search ..... 347/15, 16, 17, 347/48, 68, 84, 100, 7; 252/62.56; 338/32 R; 250/575

(56) References Cited

U.S. PATENT DOCUMENTS 4,845,456 A * 7/1989 Abe et al. ..... 338/32 R
5,241,189 A * 8/1993 Vandagriff et al. ..... 250/575
5,373,366 A 12/1994 Bowers
5,424,766 A * 6/1995 Anderson ..... 347/7
5,792,380 A * 8/1998 Wen et al. ..... 252/62.56

FOREIGN PATENT DOCUMENTS

EP 0 412 459 A2 2/1991
EP 0 571 784 A2 12/1993
JP 56080473 7/1981

* cited by examiner

*Primary Examiner*—Anh T. N. Vo
(74) *Attorney, Agent, or Firm*—Milton S. Sales

(57) ABSTRACT

An ink jet printing apparatus which is adapted to producing images using inks having predetermined concentrations of a label material therein, includes a printhead, an ink delivery system adapted to provide inks to the printhead, and a sensor associated with the ink delivery system. The sensor is sensitive to the label material in the ink and adapted to produce a signal which is characteristic of the concentration of the label material in the ink. The ink delivery system includes an ink reservoir and an ink flow channel between the ink reservoir and the printhead. The sensor is positioned to sense the concentration of the label material in the ink in the flow channel and/or in the ink reservoir. The sensor may be adapted to sense a magnetic field of the label material, an electromagnetic field of the label material, infrared photons of the label material, or fluorescent photons of the label material.

4 Claims, 4 Drawing Sheets

INK DELIVERY SYSTEM AND PROCESS FOR INK JET PRINTING APPARATUS

CROSS REFERENCE TO RELATED APPLICATIONS

This is a continuation-in-part of U.S. patent application Ser. No. 08/846,923 entitled INK DELIVERY SYSTEM AND PROCESS FOR INK JET PRINTING APPARATUS filed in the name of Xin Wen on Apr. 30, 1997 now abandoned. Reference is made to commonly assigned co-pending U.S. patent application Ser. No. 08/750,438 entitled A LIQUID INK PRINTING APPARATUS AND SYSTEM filed in the name of Kia Silverbrook on Dec. 3, 1996, and Ser. No. 08/846,693 entitled INK JET PRINTING INK COMPOSITION WITH DETECTABLE LABEL MATERIAL filed in the name of Xin Wen, et al. on Apr. 30, 1997.

FIELD OF THE INVENTION

This invention relates generally to the field of digitally controlled ink transfer printing devices, and in particular to such devices comprising sensors for label materials contained in inks to be used therewith.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Other types of piezoelectric drop-on-demand printers utilize piezoelectric crystals in push mode, shear mode, and squeeze mode. Piezoelectric drop-on-demand printers have achieved commercial success at image resolutions up to 720 dpi for home and office printers. However, piezoelectric printing mechanisms usually require complex high voltage drive circuitry and bulky piezoelectric crystal arrays, which are disadvantageous in regard to manufacturability and performance.

Great Britain Patent No. 2,007,162, which issued to Endo et al. in 1979, discloses an electrothermal drop-on-demand ink jet printer which applies a power pulse to an electrothermal heater which is in thermal contact with water based ink in a nozzle. A small quantity of ink rapidly evaporates, forming a bubble which cause drops of ink to be ejected from small apertures along the edge of the heater substrate. This technology is known as Bubblejet™ (trademark of Canon K.K. of Japan).

U.S. Pat. No. 4,490,728, which issued to Vaught et al. in 1982, discloses an electrothermal drop ejection system which also operates by bubble formation to eject drops in a direction normal to the plane of the heater substrate. As used herein, the term "thermal ink jet" is used to refer to both this system and system commonly known as Bubblejet™.

Thermal ink jet printing typically requires a heater energy of approximately 20 $\mu$J over a period of approximately 2 $\mu$sec to heat the ink to a temperature between 280° C. and 400° C. to cause rapid, homogeneous formation of a bubble. The rapid bubble formation provides the momentum for drop ejection. The collapse of the bubble causes a tremendous pressure pulse on the thin film heater materials due to the implosion of the bubble. The high temperatures needed necessitates the use of special inks, complicates the driver electronics, and precipitates deterioration of heater elements. The 10 Watt active power consumption of each heater is one of many factors preventing the manufacture of low cost high speed pagewidth printheads.

U.S. Pat. No. 4,275,290, which issued to Cielo et al., discloses a liquid ink printing system in which ink is supplied to a reservoir at a predetermined pressure and retained in orifices by surface tension until the surface tension is reduced by heat from an electrically energized resistive heater, which causes ink to issue from the orifice and to thereby contact a paper receiver. This system requires that the ink be designed so as to exhibit a change, preferably large, in surface tension with temperature. The paper receiver must also be in close proximity to the orifice in order to separate the drop from the orifice.

U.S. Pat. No. 4,166,277, which also issued to Cielo et al., discloses a related liquid ink printing system in which ink is supplied to a reservoir at a predetermined pressure and retained in orifices by surface tension. The surface tension is overcome by the electrostatic force produced by a voltage applied to one or more electrodes which lie in an array above the ink orifices, causing ink to be ejected from selected orifices and to contact a paper receiver. The extent of ejection is claimed to be very small in the above Cielo patents, as opposed to an "ink jet", contact with the paper being the primary means of printing an ink drop. This system is disadvantageous, in that a plurality of high voltages must be controlled and communicated to the electrode array. Also, the electric fields between neighboring electrodes interfere with one another. Further, the fields required are larger than desired to prevent arcing, and the variable characteristics of the paper receiver such as thickness or dampness can cause the applied field to vary.

In U.S. Pat. No. 4,751,531, which issued to Saito, a heater is located below the meniscus of ink contained between two opposing walls. The heater causes, in conjunction with an electrostatic field applied by an electrode located near the heater, the ejection of an ink drop. There are a plurality of heater/electrode pairs, but there is no orifice array. The force on the ink causing drop ejection is produced by the electric field, but this force is alone insufficient to cause drop ejection. That is, the heat from the heater is also required to reduce either the viscous drag and/or the surface tension of the ink in the vicinity of the heater before the electric field force is sufficient to cause drop ejection. The use of an electrostatic force alone requires high voltages. This system is thus disadvantageous in that a plurality of high voltages must be controlled and communicated to the electrode array. Also the lack of an orifice array reduces the density and controllability of ejected drops.

Commonly assigned U.S. patent application Ser. No. 08/750,438 entitled A LIQUID INK PRINTING APPARATUS AND SYSTEM filed in the name of Kia Silverbrook on Dec. 3, 1996, discloses a liquid printing system that affords significant improvements toward overcoming the prior art problems associated with drop size and placement accuracy, attainable printing speeds, power usage, durability, thermal stresses, other printer performance characteristics, manufacturability, and characteristics of useful inks. Silverbrook provides a drop-on-demand printing mechanism wherein the means of selecting drops to be printed produces a difference in position between selected drops and drops which are not selected, but which is insufficient to cause the ink drops to overcome the ink surface tension and separate from the body of ink, and wherein an additional means is provided to cause separation of said selected drops from said body of ink. Several drop separation techniques are disclosed by Silverbrook, the following table entitled "Drop separation means" shows some of the possible methods for separating selected drops from the body of ink, and ensuring that the selected drops form dots on the printing medium. The drop separation means discriminates between selected drops and un-selected drops to ensure that un-selected drops do not form dots on the printing medium.

Drop separation means

| Means | Advantage | Limitation |
|---|---|---|
| 1. Electrostatic attraction | Can print on rough surfaces, simple implementation | Requires high voltage power supply |
| 2. AC electric field | Higher field strength is possible than electrostatic, operating margins can be increased, ink pressure reduced, and dust accumulation is reduced | Requires high voltage AC power supply synchronized to drop ejection phase. Multiple drop phase operation is difficult |
| 3. Proximity (printhead in close proximity to, but not touching, recording medium) | Very small spot sizes can be achieved. Very low power dissipation. High drop position accuracy | Requires print medium to be very close to printhead surface, unsuitable for rough print media, usually requires transfer roller or belt |
| 4. Transfer Proximity (printhead is in close proximity to a transfer roller or belt | Very small spot sizes can be achieved, very low power dissipation, high accuracy, can print on rough paper | Not compact due to size of transfer roller or transfer belt. |
| 5. Proximity with oscillating ink pressure | Useful for hot melt inks using viscosity reduction drop selection method, reduces possibility of nozzle clogging, can use pigments instead of dyes | Requires print medium to be very close to printhead surface, not suitable for rough print media. Requires ink pressure oscillation apparatus |
| 6. Magnetic attraction | Can print on rough surfaces. Low power if permanent magnets are used | Requires uniform high magnetic field strength, requires magnetic ink |

Silverbrook discloses a liquid printing system that affords significant improvements toward overcoming the prior art problems associated with drop size and placement accuracy, attainable printing speeds, power usage, durability, thermal stresses, other printer performance characteristics, manufacturability, and characteristics of useful inks.

An ink jet printer can comprise several systems: the printheads that can utilize one of the above described printing method, an ink delivery system that supplies the ink to the printhead, a printhead transport system that transports the printhead across the page, a receiver transport system that moves receiver medium across the printhead for printing, an image data process and transfer system that provides digital signal to the printhead, a printhead service station that cleans the printhead, and the mechanical encasement and frame that support all above systems.

The ink delivery system in an ink jet printer may exist in several forms. In most page-size ink jet printers, the ink usage is relatively low. The ink is stored in a small cartridge that is attached to, or built in one unit with, the printhead. Examples of the ink cartridges are disclosed in U.S. Pat. Nos. 5,541,632 and 5,557,310. In large format ink jet printers, the ink usage per print is usually high. Auxiliary ink reservoirs are required to store large volumes of ink fluid that are connected to the ink cartridges near the printheads. Examples of auxiliary ink reservoirs are disclosed in European Patents EP 0 745 481 A2 and EP 0 745 482 A2. The level of the ink residual quantity can also be detected. For example, U.S. Pat. No. 5,250,957 discloses an ink detector that senses ink by measuring the electric resistance in the ink.

One problem for ink jet printing is in the variabilities in the physical properties and the chemical compositions in the ink. These variabilities can be caused by ink aging, or mismatching the wrong types of inks to a printer and receiver medium. The variabilities in the ink physical properties and ink chemical compositions compromise the ideal performance of the ink jet printers. For example, print density and color balance can be adversely affected by variations in the physical properties of the ink. These adverse effects can occur within a print, between prints of a given printer, and/or between prints from different printers. Print failures such as in-jet nozzle plugging can also occur as a result of the above described variabilities.

DISCLOSURE OF THE INVENTION

It is an object of the present invention to overcome to the previously described difficulties.

It is another object of the present invention to provide for monitoring ink colorant concentrations for reducing variabilities in color gamut and print densities.

It is still another object of the present invention to provide for detecting ink type during the ink refilling process so that the ink matches the printer and the receiver media for achieving the best print image qualities.

It is yet another object of the present invention to provide for detecting ink type before printing so that the ink matches the printer and the receiver media for achieving the best print image qualities.

In accordance with a feature of the present invention, an ink jet printing apparatus which is adapted to producing images using inks having predetermined concentrations of a label material therein, includes a printhead, an ink delivery system adapted to provide inks to the printhead, and a sensor associated with the ink delivery system. The sensor is sensitive to the label material in the ink and adapted to produce a signal which is characteristic of the concentration of the label material in the ink.

According to another feature of the present invention, the ink delivery system includes an ink reservoir and an ink flow channel between the ink reservoir and the printhead. The sensor is positioned to sense the concentration of the label material in the ink in the flow channel.

According to still another feature of the present invention, the ink delivery system includes an ink reservoir and an ink flow channel between the ink reservoir and the printhead. The sensor is positioned to sense the concentration of the label material in the ink in the ink reservoir.

According to various preferred embodiments of the present invention the sensor is adapted to sense a magnetic field of the label, an electromagnetic field of the label material, infrared photons of the label material, or fluorescent photons of the label material.

According to still another feature of the present invention, a process for ink refilling comprising the steps of detecting the presence of a label material in ink and rejecting inks that do not contain the label material.

According to still another feature of the present invention, a process for ink refilling comprising the steps of detecting the concentration of a label material in ink and rejecting inks that do not contain at least a predetermined concentration of the label material.

According to still another feature of the present invention, a process for ink refilling comprising the steps of detecting the concentration of a label material in ink and rejecting inks that do not contain the label material within a predetermined concentration range.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 1(*b*) is a cross sectional view of a nozzle tip usable in the present invention;

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
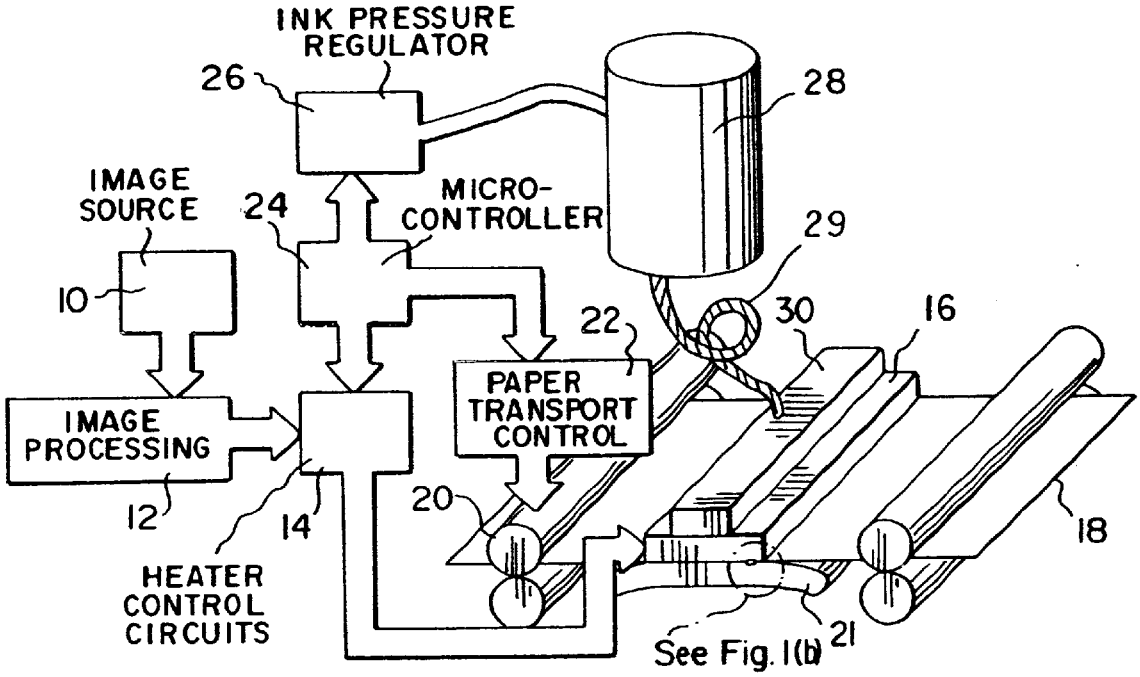
FIG. 1(*a*) shows a simplified block schematic diagram of one exemplary printing apparatus according to the present invention.
Figure 1B:
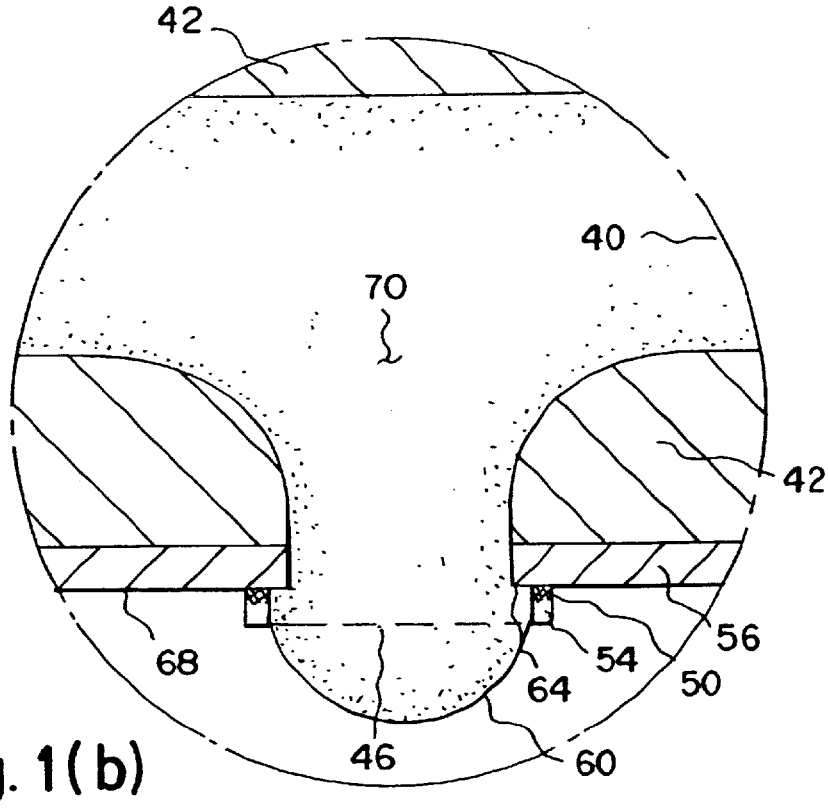

FIG. 1(*a*) is a drawing of an ink transfer system utilizing a printhead which is capable of producing a drop of controlled volume. An image source 10 may be raster image data from a scanner or computer, or outline image data in the form of a page description language, or other forms of digital image representation. This image data is converted by an image processing unit 12 to a map of the thermal activation necessary to provide the proper volume of ink for each pixel. This map is then transferred to image memory. Heater control circuits 14 read data from the image memory and apply time-varying or multiple electrical pulses to selected nozzle heaters that are part of a printhead 16. These pulses are applied for an appropriate time, and to the appropriate nozzle, so that selected drops with controlled volumes of ink will form spots on a recording medium 18 after transfer in the appropriate position as defined by the data in the image memory. Recording medium 18 is moved relative to printhead 16 by a paper transport roller 20, which is electronically controlled by a paper transport control system 22, which in turn is controlled by a micro-controller 24.

Micro-controller 24 also controls an ink pressure regulator 26, which maintains a constant ink pressure in an ink reservoir 28 for supply to the printhead through an ink connection tube 29 and an ink channel assembly 30. Ink channel assembly 30 may also serve the function of holding the printhead rigidly in place, and of correcting warp in the printhead. Alternatively, for larger printing systems, the ink pressure can be very accurately generated and controlled by situating the top surface of the ink in reservoir 28 an appropriate distance above printhead 16. This ink level can be regulated by a simple float valve (not shown). The ink is distributed to the back surface of printhead 16 by an ink channel device 30. The ink preferably flows through slots and/or holes etched through the silicon substrate of printhead 16 to the front surface, where the nozzles and heaters are situated.

FIG. 1(*b*) is a detail enlargement of a cross-sectional view of a single nozzle tip of the drop-on-demand ink jet printhead 16 according to a preferred embodiment of the present invention. An ink delivery channel 40, along with a plurality of nozzle bores 46 are etched in a substrate 42, which is silicon in this example. In one example the delivery channel 40 and nozzle bore 46 were formed by anisotropic wet etching of silicon, using a $p^+$ etch stop layer to form the shape of nozzle bore 46. Ink 70 in delivery channel 40 is pressurized above atmospheric pressure, and forms a meniscus 60 which protrudes somewhat above nozzle rim 54, at a point where the force of surface tension, which tends to hold the drop in, balances the force of the ink pressure, which tends to push the drop out.

In this example, the nozzle is of cylindrical form, with a heater 50 forming an annulus. In this example the heater was made of polysilicon doped at a level of about thirty ohms/square, although other resistive heater material could be used. Nozzle rim 54 is formed on top of heater 50 to provide a contact point for meniscus 60. The width of the nozzle rim in this example was 0.6 $\mu$m to 0.8 $\mu$m. Heater 50 is separated from substrate 42 by thermal and electrical insulating layers 56 to minimize heat loss to the substrate.

The layers in contact with the ink can be passivated with a thin film layer 64 for protection, and can also include a layer to improve wetting of the nozzle with the ink in order to improve refill time. The printhead surface can be coated with a hydrophobizing layer 68 to prevent accidental spread of the ink across the front of the printhead. The top of nozzle rim 54 may also be coated with a protective layer which could be either hydrophobic or hydrophillic.

In the quiescent state (with no ink drop selected), the ink pressure is insufficient to overcome the ink surface tension and eject a drop. The ink pressure for optimal operation will depend mainly on the nozzle diameter, surface properties (such as the degree of hydrophobicity) of nozzle bore 46 and rim 54 of the nozzle, surface tension of the ink, and the power and temporal profile of the heater pulse. The ink has a surface tension decrease with temperature such that heat transferred from the heater to the ink after application of an electrothermal pulse will result in the expansion of poised meniscus 60.

For small drop sizes, gravitational force on the ink drop is very small; approximately $10^{-4}$ of the surface tension forces, so gravity can be ignored in most cases. This allows printhead 16 and recording medium 18 to be oriented in any direction in relation to the local gravitational field. This is an important requirement for portable printers.

Figure 2:
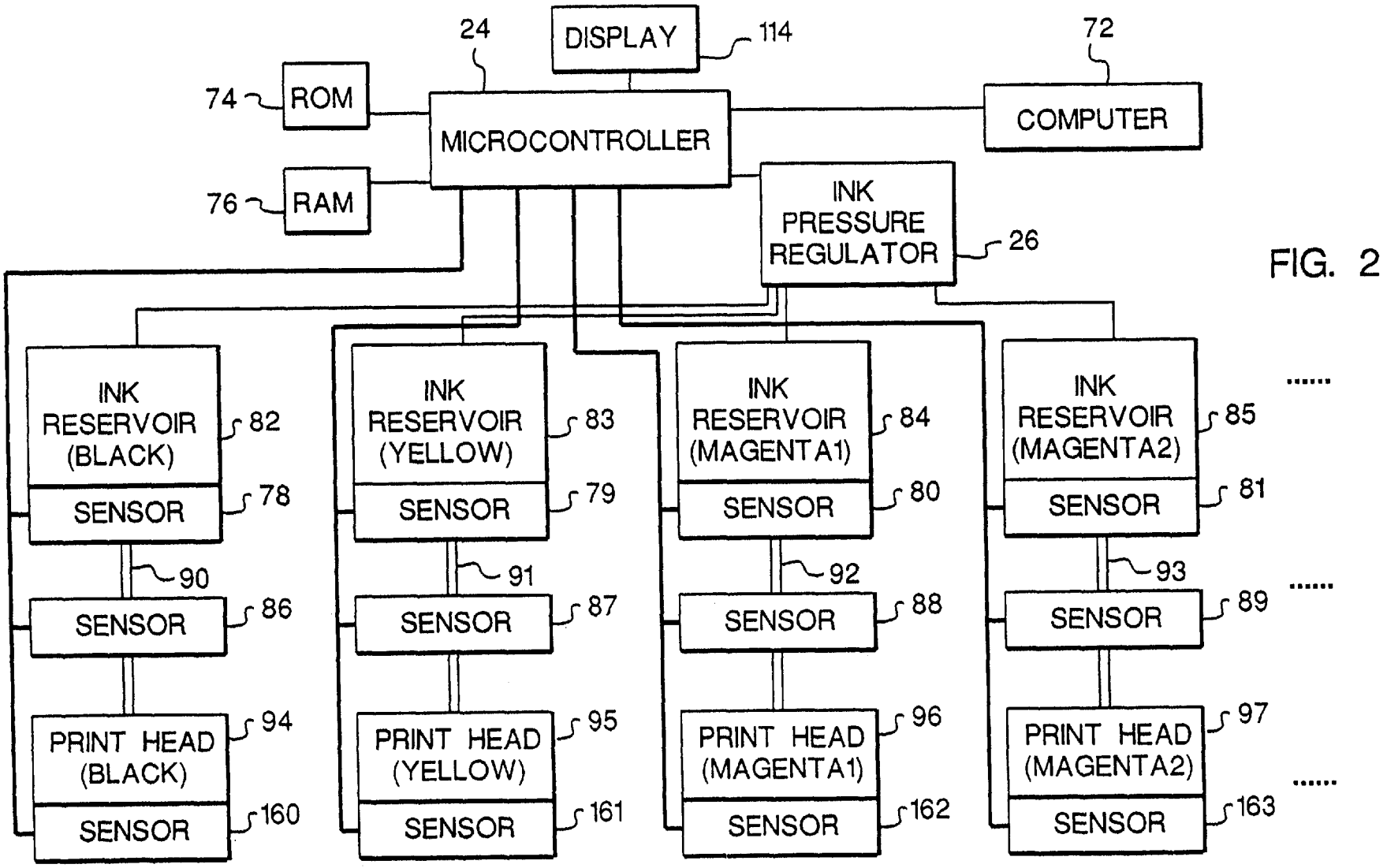
FIG. 2 is a block diagram of the ink delivery system in the present invention.

FIG. 2 illustrates the ink delivery system of a preferred embodiment of the present invention. Microcontroller 24 (also shown in FIG. 1(*a*)) is connected to a computer 72, a Read Only Memory (ROM) 74 a Random Access Memory (RAM) 76, and ink pressure regulator 26 that regulates the ink pressure in ink reservoirs 28. Microcontroller 24 is also connected to four ink sensors 78–81 that detect predetermined characteristics of the inks in the ink reservoirs 82–85, respectively. Reservoirs 82–85 correspond to reservoir 28 of FIG. 1(*a*). Microcontroller 24 is also connected to four ink sensors 86–89 that detect characteristics of the inks in ink connection tubes 90–93, corresponding to ink connection tube 29 of FIG. 1(*a*). Microcontroller 24 is also connected to the holder of the ink cartridge (not shown) for detecting the presence of the ink cartridge. Microcontroller 24 is further connected to ink sensors 160–163 for detecting characteristics of the inks in the printheads 94–97. The ink jet printer can utilize multiple printheads 94–97, with each printhead connected to one ink reservoir. The ink types include black, yellow, magenta, and cyan colors and can also include several inks within each color. For example, labels "magental" and "magenta2" in FIG. 2 can represent magenta inks at different colorant concentrations.

Sensors 78–81, 86–89 and 160–163 can detect the existence and the colorant concentration in the ink by sensing a detectable label material in the ink. The term "detectable label material" refers herein to an ink ingredient that is added to the ink and is detectable by sensors 78–81 and 86–89 in the ink delivery system and sensors 160–163 in the printheads. The concentration of the detectable label material to the concentration of the colorant is held as constant in the ink. The detectable label material is, however, not required to perform any other functions in the printhead or on the receiver media. In other words, the ink can achieve desired print qualities without the assistance of the detectable label materials.

One detectable label material which may be used is fine magnetic particles of magnetite $Fe_3O_4$ to produce a black magnetic ink when blended with black pigment and solvent (s). The magnetite particles can be refined in procedures as disclosed in U.S. Pat. No. 4,405,370. The concentration of the magnetic particles is predetermined during manufacture. Details of a black pigmented ink containing a magnetic label material, e.g., is disclosed in commonly assigned, co-pending U.S. patent application Ser. No. 08/846,693 filed Apr. 30, 1997. Magnetic inks exist in many other colors, and may be used in accordance with the present invention. Details of preparation of colored magnetic inks can be found in U.S. Pat. No. 5,506,079.

Various magnetic sensors can be used to detect the presence and concentration of magnetic label material in inks. For example, sensors are known wherein an internal resistance changes as a function of the magnetic field strength experienced by the sensor. This is an indication of the concentration of magnetic label material in the ink, the resistance of the magnetic sensors varies as a function of the magnetic field strength. Details of the detection circuits for the magnetic resistance sensors are disclosed in U.S. Pat. Nos. 4,845,456 and 5,483,162. One type of magnetic resistance sensors is the thin-film magnetoresistance sensors. This type of sensors is described in U.S. Pat. Nos. 5,225,951, 5,274,520 and 5,351,158. Also, Hall-effect magnetic sensors, as disclosed in U.S. Pat. No. 4,931,719, can also be used for the purpose of the present invention.

It is understood that the magnetic ink and magnetic sensors used above are only as examples. Many other interactions can be used in the sensing of the detectable label material in the ink by the sensors. The detectable label materials can, for example, be detected by their respective sensors through an electromagnetic field, by ultraviolet, visible, infrared or fluorescent photons.

Figure 3:
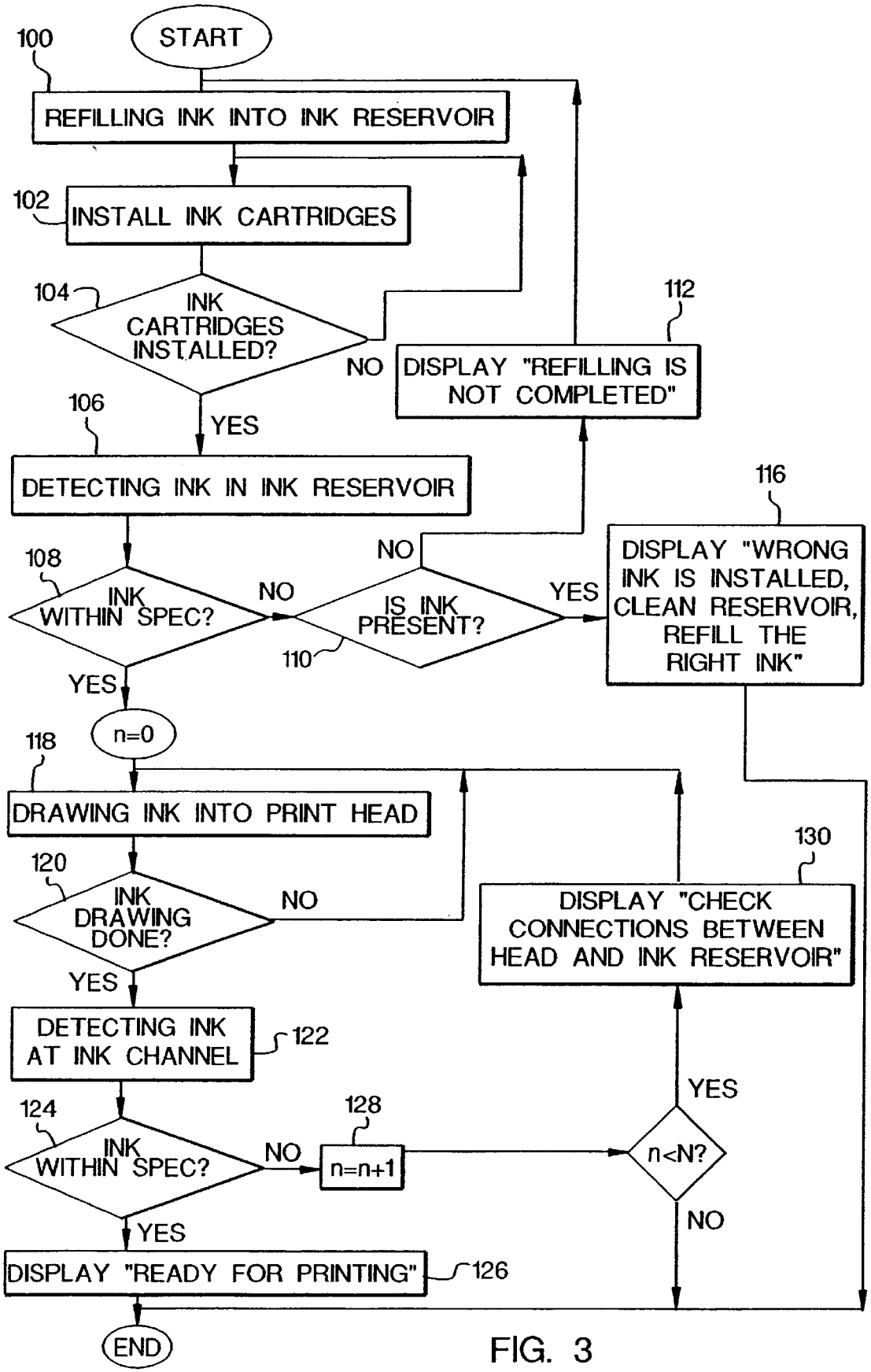
FIG. 3 shows the work flow diagram of the ink refilling process in the present invention.

Referring to the chart of FIG. 3, ink refilling starts with refilling ink into one or more of reservoirs 82–85; block 100. The ink can be refilled with the assistance of a syringe or by siphoning. Alternatively, an empty ink reservoir can also be replaced by a new one; block 102. Microcontroller 24 determines at block 104 whether an ink cartridge is installed, if not, the operator is asked to install ink cartridges.

Next, microcontroller 24 asks sensors 78–81 to detect the detectable label materials in the inks contained in ink reservoirs 82–85; block 106. For example, the electric resistance of magnetic resistance sensors may be measured. The magnetic field strength is calculated, from which the concentration of the label material in the ink is deduced. Since the concentration of the pigments and the concentration of the label material is known from the ink manufacturer, the colorant concentration is obtained. If the outputs of sensors 78–81 are outside of the specification for optimum performance as determined at block 108, the operator is then asked to check whether ink is present in the reservoir; block 110. If it is not, a message "refilling is not complete" will be displayed (block 112) on a display 114, shown in FIG. 2. The operator is thereby instructed to initiate the refilling process. If, however, the ink is observed to be present in the ink reservoir, a message such as "wrong ink is installed in the reservoir" will be presented (block 116) on display 114. The machine may at that time be disabled until the correct ink has been provided. Alternatively, the operator may be provided with the means to selectively operate the machine in spite of the presence of the wrong ink.

If the calculated colorant concentration is within specification in the ink, a counter n is set to zero and the ink is drawn from the ink reservoir through ink connection tube 29 to the associated printhead 94–97; block 118. After the ink drawing is completed as determined at block 120, the ink in the ink connection tube will be detected by sensors 86–89; block 122. Alternatively, the ink in the printheads can also be detected by sensors 160–163; block 122. If the ink colorant concentration calculated is within specification (block 124), the printer is ready for printing and a message will be displayed (block 126) on display 114. If the ink outside of specification, the counter n is incremented by one (block 128), and compared to a maximum number N for the ink drawing interactions. If n is less than N, the ink delivery system will be checked and the ink drawing steps repeated; block 130. If n is greater than N, the ink refilling procedure is terminated.

Figure 4:
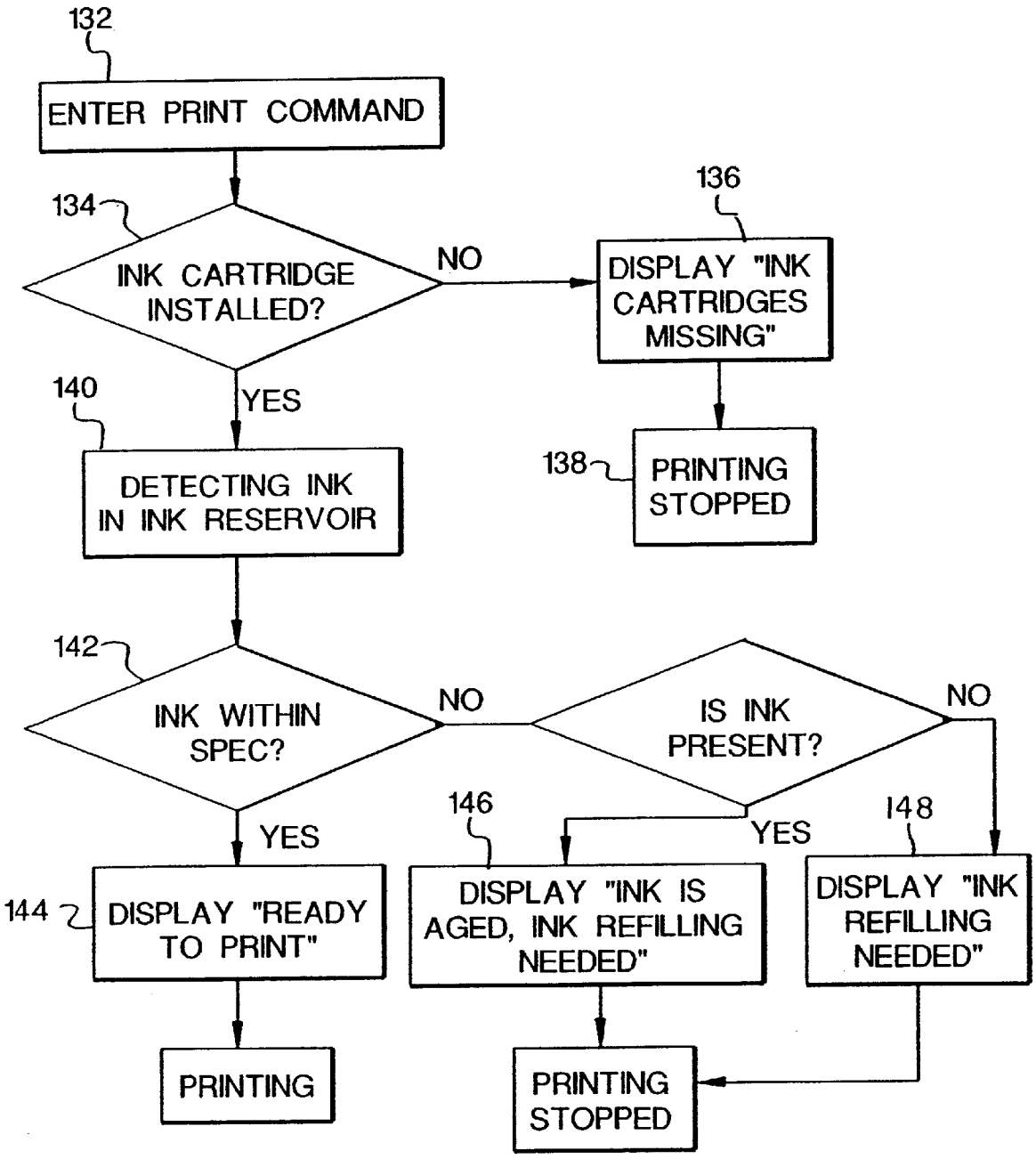
FIG. 4 shows the work flow diagram of the printing preparation process in the present invention.

Referring to FIG. 4, upon entering a print command (block 132), microcontroller 24 checks to see if the ink cartridges are properly installed; block 134. If not, a message will be displayed on display 114 and the printing procedure is terminated; blocks 136 and 138, respectively. If the inks in the ink reservoirs are detected by sensors 78–81 (block 140) and the colorant concentrations in the inks are calculated as described above to be within specification (block 142), the printer is ready to print with a message displayed; block 144. If the ink is outside of the specification, the ink may be aged, and a requirement of a refilling procedure is displayed; block 146, and the printing preparation is stopped. If the ink is not present, display 114 will indicate that the one of ink reservoirs 82–85 is empty, block 148, and the printing preparation procedure is terminated. The above procedure is intended to illustrate one example of the print preparation algorithm. In many cases, sensors 86–89 and sensors 160–163 can also be used to ensure the proper characteristics of the inks in the ink connection tubes 90 and printheads 94–97 for determining whether printing operation should proceed.

The invention has been described in detail with particular reference to preferred embodiments thereof, but it will be understood that variations and modifications can be effected within the spirit and scope of the invention.

What is claimed is:

1. An ink jet printing apparatus adapted to producing images using inks having predetermined concentrations of a label material therein; said apparatus comprising:

a printhead;

an ink delivery system adapted to provide inks to the printhead; and a sensor associated with said ink delivery system, said sensor being sensitive to the label material in the ink and adapted to produce a signal which is characteristic of the concentration of the label material in the ink, wherein the sensor is adapted to sense a magnetic field of the label material.

2. An ink jet printing apparatus adapted to producing images using inks having predetermined concentrations of a label material therein; said apparatus comprising:

a printhead;

an ink delivery system adapted to provide inks to the printhead; and a sensor associated with said ink delivery system, said sensor being sensitive to the label material in the ink and adapted to produce a signal which is characteristic of the concentration of the label material in the ink, wherein the sensor is adapted to sense an electromagnetic field of the label material.

3. An ink jet printing apparatus adapted to producing images using inks having predetermined concentrations of a label material therein; said apparatus comprising:

a printhead;

an ink delivery system adapted to provide inks to the printhead; and a sensor associated with said ink delivery system, said sensor being sensitive to the label material in the ink and adapted to produce a signal which is characteristic of the concentration of the label material in the ink, wherein the sensor is adapted to sense infrared photons of the label material.

4. An ink jet printing apparatus adapted to producing images using inks having predetermined concentrations of a label material therein; said apparatus comprising:

a printhead;

an ink delivery system adapted to provide inks to the printhead; and a sensor associated with said ink delivery system, said sensor being sensitive to the label material in the ink and adapted to produce a signal which is characteristic of the concentration of the label material in the ink, wherein the sensor is adapted to sense fluorescent photons of the label material.

* * * * *